US007527487B2

(12) United States Patent
Becker et al.

(10) Patent No.: US 7,527,487 B2
(45) Date of Patent: May 5, 2009

(54) DEVICE FOR MOULDING MIXTURES

(75) Inventors: Guenter Becker, Aarbergen (DE); Helmut Kuch, Weimar (DE); Juergen Martin, Jena (DE); Joerg-Henry Schwabe, Weimar (DE)

(73) Assignee: Institut für Fertigteiltechnik und Fertigbau Weimar e.V., Weimar (DE)

( * ) Notice: Subject to any disclaimer, the term of this patent is extended or adjusted under 35 U.S.C. 154(b) by 253 days.

(21) Appl. No.: 10/544,424

(22) PCT Filed: Jan. 30, 2004

(86) PCT No.: PCT/EP2004/000850

§ 371 (c)(1),
(2), (4) Date: Jun. 5, 2006

(87) PCT Pub. No.: WO2004/069504

PCT Pub. Date: Aug. 19, 2004

(65) Prior Publication Data

US 2009/0087511 A1 Apr. 2, 2009

(30) Foreign Application Priority Data

Feb. 5, 2003 (DE) ..... 203 01 954 U

(51) Int. Cl.
*B28B 1/10* (2006.01)

(52) U.S. Cl. ..... 425/3; 425/195; 425/421; 425/432

(58) Field of Classification Search ..... 425/3, 425/195, 421, 432, DIG. 127
See application file for complete search history.

(56) References Cited

U.S. PATENT DOCUMENTS 3,568,272 A * 3/1971 Zmania ..... 425/432
4,008,021 A * 2/1977 Fedrigo et al. ..... 425/421
4,725,220 A 2/1988 Percinel et al.
5,002,711 A * 3/1991 Iwama et al. ..... 425/421
5,355,732 A 10/1994 Anderl et al.
2003/0113397 A1* 6/2003 Bald ..... 425/421

FOREIGN PATENT DOCUMENTS

| | | | |
|---|---|---|---|
| DE | 277 427 | A1 | 4/1990 |
| DE | 38 39 556 | A1 | 6/1990 |
| DE | 9406873 | | 8/1994 |
| EP | 0 515 305 | A1 | 11/1992 |
| EP | 0 692 317 | A1 | 1/1996 |

OTHER PUBLICATIONS

Roemheld, Edition 11-96 (1 pg.).
Deuring, K., excerpt from "Spannen im Maschinenbau," pp. index, 33-41 (1953).

* cited by examiner

*Primary Examiner*—James Mackey
(74) *Attorney, Agent, or Firm*—Patterson, Thuente, Skaar & Christensen, P.A.

(57) ABSTRACT

The invention relates to a device for moulding mixtures, preferably concrete mixtures for producing blocks. The device comprises a mould for receiving the concrete mixture, a table, to which the mould is coupled by means of brace elements, a vibration generation system, mounted on the table, for generating harmonic vibrations and for transmitting the latter to the table, a load in the form of a ram for exerting a force on the concrete mixture, first spring elements for elastically supporting the table and second spring elements for elastically supporting the load. A device of this type is equipped with at least eight rotating unbalanced shafts with parallel rotational axes in the vibration generation system. The unbalanced shafts are coupled in pairs for their rotational motion, each pair of unbalanced shafts having a common rotational axis and being driven independently of the other pairs.

15 Claims, 3 Drawing Sheets

DEVICE FOR MOULDING MIXTURES

FIELD OF THE INVENTION

The invention relates generally to masonry production, and more particularly, to apparatus, systems, and processes relating to the shaping of conglomerates, such as concrete conglomerates using harmonic vibration.

BACKGROUND OF THE INVENTION

For the manufacture of small-format concrete ware in industrial production the devices now mostly used employ the principle of shock vibration for the compacting of the concrete conglomerate. Systems for the generating of vibration are used with such devices that are based on unbalance shafts driven by electric motors as described in detail, for example, in the article "Increasing the Quality of Production by Efficient Compacting" by Berthold Schlecht and Alexander Neubauer appearing in the periodical "Betonwert+Fertigteil–Technik" at pages 44 to 52 of Issue No. 9/2000. On the underside of the table upon which the input form places the concrete conglomerate, but not tightly mounted, there are attached, respectively, two unbalance shafts or two pairs of unbalance shafts so that, in the latter case, the unbalance shafts are put into forced synchronization either mechanically using gears or electronically. As a rule the input form is thus comprised of a so-called pallet—a plank, a plastic slab, or a steel sheet—and a molding box whose side walls define the concrete ware and lie on the pallet. This is primarily due to reasons of production technology, as the removal of the finished concrete ware is done on these pallets, but the process has also been influenced significantly by shock vibration.

Such devices are burdened by disadvantages, however, in that, for the optimal compacting of the concrete as a rule high momentary accelerations are required of as great as 200 $m/s^2$. With the known devices, however, only unbalance forces of a maximum of 200 kN can be provided because, among other things, the bearings of the rotating unbalances would otherwise be exposed to unacceptably high loads along with very short bearing lifetimes. Given the fact that the high accelerations required cannot be provided by means of the harmonic vibration of the table generated by unbalance agitation, they must be produced by another means. This is done with the assistance of so-called shock vibration. In this manner, the high accelerations necessary are generated, briefly each time, by means of so-called concussion hits between the components of the table, pallet, and mold box that are not tightly connected to each other. Furthermore, the generating of the concussion hits occurs by means of knock ridges arranged in a stationary position parallel to the table. The installation of these knock ridges is done purely empirically by matching various mechanical parameters and thus does not always provide optimum adjustment and optimal compacting. The use of a different concrete or a different form thus entails extensive installation work. Further disadvantages of shock vibration are the high emission of noise connected with the concussion hits, the high mechanical load, and high wear on the equipment. The latter also leads to losing the optimal adjustment of the machine and a worsening of the quality of the product.

If one desires to avoid shock vibration one must make up for the absence of the acceleration peaks generated by concussion hits with the concomitant higher forces in harmonic vibration. However, with the known motorized unbalance agitators such higher forces cannot be created. Indeed, use has been made of one or more hydraulically operated servo cylinders instead of motor-driven unbalance agitators so as to be able to generate the higher forces and to make use of the principle of harmonic vibration. There is also a description of the devices based on hydraulic operation for concrete masonry production in the article by Schlecht and Neubauer mentioned above as well as in Application WO 01/47698 A1. The advantages of harmonic vibration are, among other things, that the wear is significantly reduced, there is a reduction in the noise emissions, as the pallet, mold box, and table are tightly connected in this case, the cement usage can be reduced, and the production times may be significantly reduced.

There is also a disadvantage present in the choice of hydraulics as of the operating method, however. First of all, servo hydraulics require that the oil be extremely clean, which can only be achieved in the environment of a concrete plant with high expenditure. Furthermore, the energy requirements of a device based on hydraulics are distinctly higher than those of the conventional shock vibration devices operated by electric motors. Moreover, the production costs of such a servo hydraulic system are distinctly higher than those for a electric motor drive.

In Application WO 01/47698 A1 it is indeed proposed that harmonic vibrations be generated, but no method is referred to for overcoming the known disadvantages of the state of the art as mentioned above.

SUMMARY OF THE INVENTION

One aspect of the invention is directed to a device for the compacting of conglomerates, especially of concrete conglomerates for concrete masonry production, utilizing harmonic vibration that does not suffer from the disadvantages of shock vibration and of hydraulic operation, yet still provides sufficiently high accelerations or forces.

A device according to one embodiment of the invention includes a form for the input of the concrete conglomerate, a table with which the form is coupled using mounting components, a vibration generation system attached to the table for the generation of harmonic vibrations and their transfer to the table, a load in the form of a piston to admit the concrete conglomerate with a force, first spring components for the elastic positioning of the table, and second spring components for the elastic positioning of the load.

The device addresses the aforementioned problem of concrete masonry production by employing harmonic vibration. An exemplary vibration generation system includes at least eight rotating shafts in unbalance with rotation axes that are parallel to each other. The unbalance shafts are thus coupled in pairs in their rotational motions and each pair of unbalance shafts has a shared rotation axis that is driven independently of the other pairs. Unlike a conventional device, one balance shaft is thus replaced by a coupled pair of unbalance shafts.

According to one embodiment, the unbalance shafts are generally made shorter and more compact. For example, in order to generate a total force of 600 kN, a force of at least 75 kN must be provided per individual unbalance, that, unlike conventional unbalance shafts, can be reached with a higher unbalance $U=m_u r_u$, where the unbalance mass is $m_u$ and the unbalance radius is $r_u$. The transfer of a distinctly higher total force is made possible by the fact that eight unbalance shafts are used instead of four in that, as each unbalance shaft is customarily positioned on the table in two roller bearings, the total force can thus be spread out over 16 roller bearings instead of eight.

In order to reduce the wear it is advantageous for the unbalance shafts to provide for an elasticity of EI greater than or equal to $2\times10^5$ $Nm^2$, where EI is the elasticity modulus designated for the material used for the unbalance shafts and I is the momentary surface inertia of the unbalance shafts. It is necessary that the unbalance shafts be made of steel for this, with a diameter of at least 80 mm.

The coupling of the rotational motion of two in a pair of connected unbalance shafts can be configured as electronic coupling so that the unbalance shafts are driven in synchronization and the synchronization is provided by an electronic control. The coupling in pairs of two unbalance shafts by means of an elastic coupling is simpler and less expensive, however, and thus preferable. Preferably, it is made as strong as possible due to the torsion from misalignments that can develop from divergences in the momentary local positions of the rotation axes of the two unbalance shafts in relation to each other in the area of the coupling, and it is preferably made as tolerant as possible Preferably, the elastic coupling has a torsion strength of at least $10^4$ Nm/rad and a radial spring strength of $2\times10^7$ N/m at most.

The table with form and concrete conglomerate can be put into harmonic vibration with particular effectiveness when the vibrations generated by the unbalance agitators match the natural frequency of the oscillation band on the first spring components that serve for the elastic positioning of the table given that, in such case, their resonance can be used. For this, as a rule, the first spring components are made particularly stiff. This has the disadvantage that, in the creation of resonance, an enormous transfer of vibration to the environment also occurs. The same circumstance also affects the load and the second spring components and the second spring components for the elastic positioning of the load. However, one can obtain good vibration isolation from the environment only with weak first and second spring components. The only useful resonance vibrations are the ones that happen to be the ones sent through the concrete conglomerate by the relative movement between the table and the load. However, a concrete spring with such effect acutely depends on the conglomerate and on the progress of the compacting and therefore the use of resonance is made difficult.

In a preferred configuration, the table and load are thus coupled on three spring components. Advantageously, the third spring component is a mechanical or hydraulic spring with respectively variable spring strengths. This third spring component can then be adjusted to a given operating frequency so that changes in the spring strength of the concrete spring have a distinctly lesser effect on the sum of all springs and can even be offset by variable spring strengths of the third spring component.

In another configuration, the bracing of the form and the table is provided by tension members as mounting components with hydraulic or pneumatic traction. At one end they are attached to the table and at the other end they are connected to the form in a flexible fastened state. As an alternative one end of the tension members can also be attached to the form and at the other end they are connected to the table in a flexible fastened state. In this way, the linkage position of the bracing at the table can be decreased in level. The use of tension members, unlike the conventional use of bracing levers at the level of the form junction, has the advantage that parts that project out far can be avoided, such as those needed conventionally for the mounting mechanism, which are especially prone to being fractured in the high vibration accelerations generally created by the use of harmonic vibrations and resonance.

In a preferred configuration, the tension members are connected to the table with their ends at an angle of more than zero degrees in relation to the perpendicular, preferably at an angle of between ten degrees and thirty degrees. This has the advantage that the mounting contours, that is, the means by which the flexible fastening is created, can be taken out by slackening from the collision space of the form stroke motion and the form can be thus more easily taken out and exchanged.

In a preferred embodiment the mounting components at the table are wedges and at the form are tie rods availed of openings for the passage of the wedges so that, in the fastened state, the wedges enter the openings of the tie rods. To increase and decrease the tension, a hydraulic or pneumatic forward and reverse drive is utilized for the wedges.

In a further configuration, electromagnets are used as the mounting components connected at the table. To this end, the form is made of a material that can be magnetized, such as steel. If a two-part form is used, then not only the mold box but also the pallet between the form box and the table can be made of a material that can be magnetized, such as, for example, steel sheet. If the magnets are turned on when there is an available form, they pull on the form by electromagnetic force and brace it in that manner.

DETAILED DESCRIPTION OF THE PREFERRED EMBODIMENTS

A preferred embodiment of a device for the shaping of conglomerates such as concrete conglomerates for masonry work, includes a form for the input of the concrete conglomerate, a table with which the form is coupled using mounting components, a vibration generation system attached to the table for the generating harmonic vibrations to be transferred to the table, a load in the form of a piston to admit the concrete conglomerate with a force, first spring components for the elastic positioning of the table, and second spring components for the elastic positioning of the load. The vibration generation system preferably includes at least eight rotating unbalance shafts provided with rotational axes parallel to each other. The unbalance shafts are coupled into pairs as to their rotational motion so that each pair of unbalance shafts shares a rotational axis and is driven independently of the other pairs.

Figure 1:
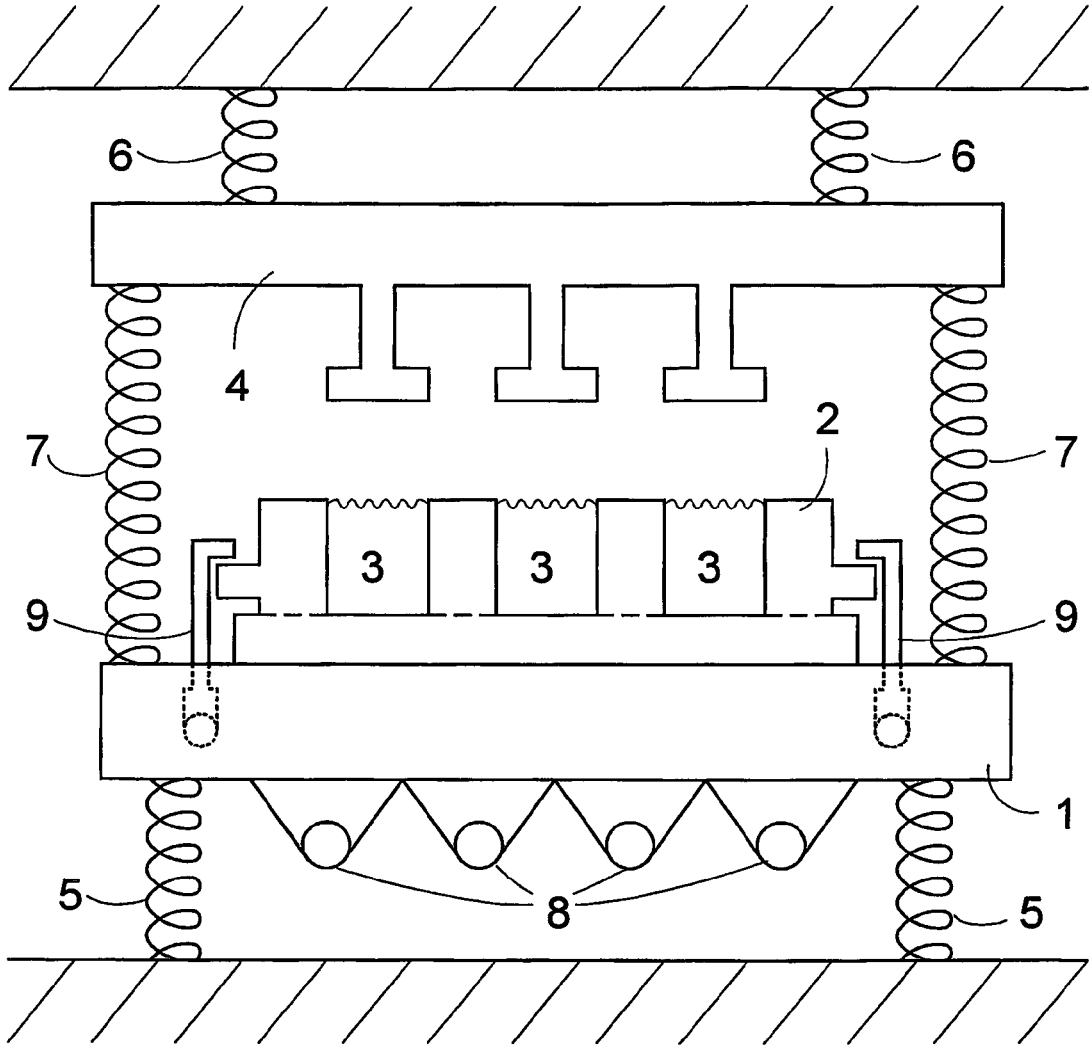
FIG. 1 illustrates a device for the shaping of conglomerates from a side view.

FIG. 1 illustrates the main construction of a device in accordance with one embodiment for the shaping of conglomerates, especially for the production of masonry concrete. Onto a table 1 a form 2 containing the concrete conglomerate 3 is moved. Form 2 can be made of one piece but usually the floor and side surfaces of the concrete masonry define different parts that can be separated from each other, as is clearly shown in the drawing by the broken line in form 2. The side surfaces are defined by a mold box of steel and, for the definition of the bottom surfaces, a so-called pallet can be used, such as, for example, a plank or a steel sheet, upon which the finished concrete masonry can be transported away. A load 4 is positioned over form 2. On the underside of the table 1 the first spring components 5 are arranged that provide the elastic positioning of the table in relation to the environment. The second spring components 6 are positioned in load 4 to provide the elastic positioning of the load. Table 1 and load 4 are coupled by the third spring components 7. Under table 1, eight rotating unbalance shafts 8 are positioned so that the unbalance shafts 8 are coupled in pairs as to their rotation motion and each pair of unbalance shafts 8 shares a rotational axis. The rotational axes of the unbalance shafts 8 in FIG. 1 run perpendicular to the line of view. By means of the unbalance shafts 8, driven in rotation, table 1 along with form 2 and the concrete conglomerate 3 found therein are put into harmonic vibration. It thus vibrates against load 4, which is coupled with the table through the concrete conglomerate 3 and the third spring components 7 and it too is put into vibration.

The third spring components 7 are designed so that, depending on the concrete conglomerate, the resonance of the vibration system of table 1 and load 4 together can be used as effectively as possible through the entire compacting process, that is, the dependency of the resonance frequency of the compacting state of the concrete conglomerate, which would be very acute without the employment of the third spring components 7, is lessened to the extent possible. The third spring components 7 are situated so that the relative movements occurring between table 1 and load 4 in compacting and unframing are enabled. This can be carried out, for example, with the assistance of hydraulic cylinders. Another possibility is to use the third spring components 7 only part of the time, when table 1 and load 4 are coupled in order to move against each other. Here, steel, rubber, or air springs can be used.

During the vibration process, form 2 is attached to the table by mounting components. In FIG. 1 the mounting components are shown as tie rods 9, hydraulically operated, that have one of their ends attached in a rotatable manner to the table to form an axis perpendicular to the plane of the drawing. For the mounting of form 2 on table 1, tension on form 2 downward is employed using the hydraulic tie rods 9, and for slackening the upper ends of the tie rods 9 are pushed upward by the hydraulics and swung out to the side so that the form can be easily exchanged.

As an alternative to that the hydraulically driven tie rods can also be arranged with a slight angle of about 10 degrees to 30 degrees in relation to the perpendicular. They no longer would need to be swung out to the side given that, using the diagonal arrangement of the mounting contours, they can be taken out by slackening, depending on the construction, from the collision space of the form stroke motion and the form can be thus more easily taken out and exchanged.

Figure 2:
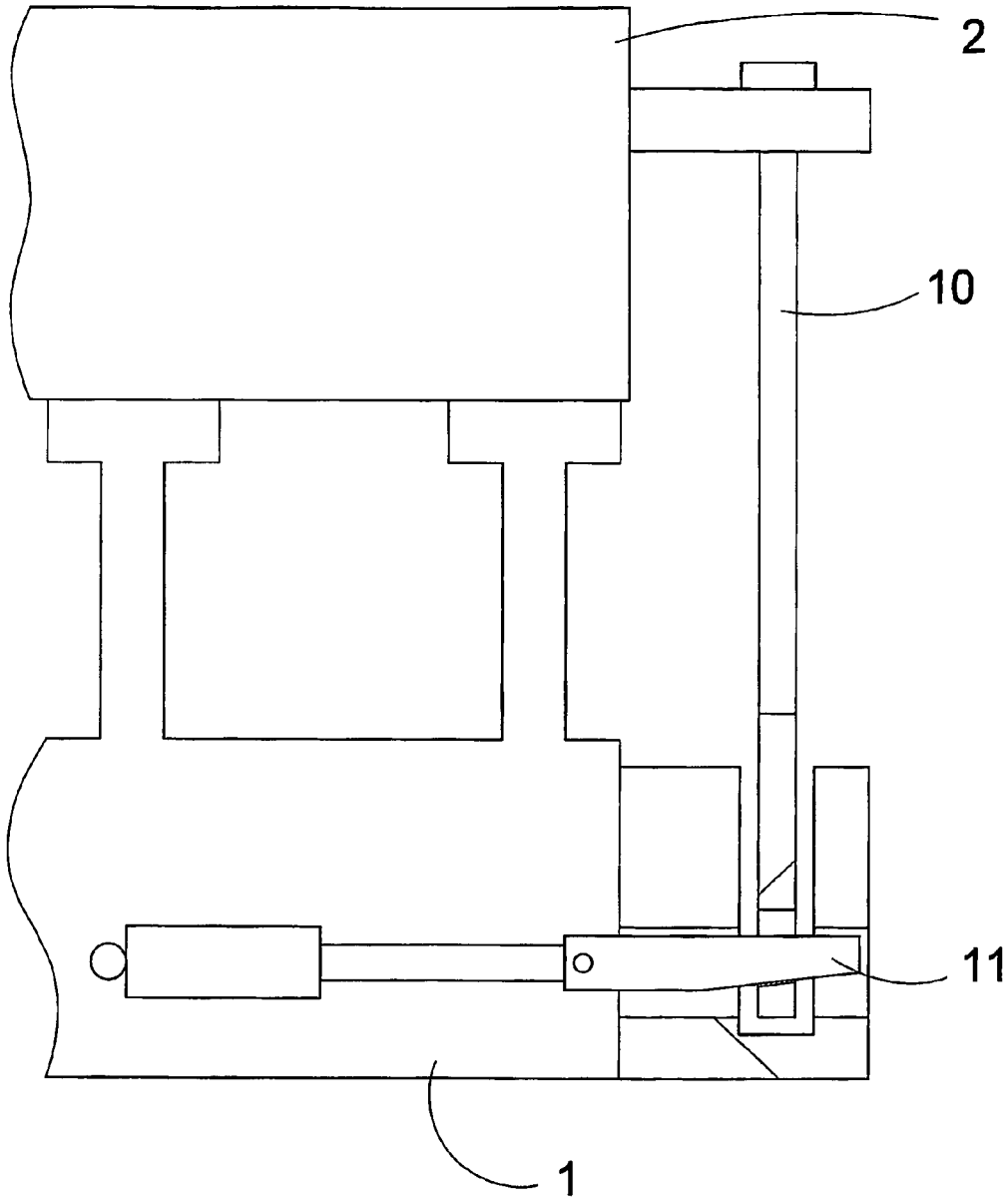
FIG. 2 illustrates an exemplary mounting mechanism in accordance with one aspect of the invention.

In FIG. 2 a further alternative for the mounting mechanism is shown. A tie rod 10 is attached to form 2, here configured as a single piece. The bottom end of tie rod 10 extends into a notched area of the table 1 provided for it. The crosshatched portion of tie rod 10 and table 1 in FIG. 2 show a cross section through both of the components. On the bottom end of tie rod 10 there is an opening in which a wedge 11 attached to the table is hydraulically driven. Wedge 11 can be drawn back by means of hydraulics out of the opening of tie rod 10 and form 2 can be removed from table 1.

Figure 3:
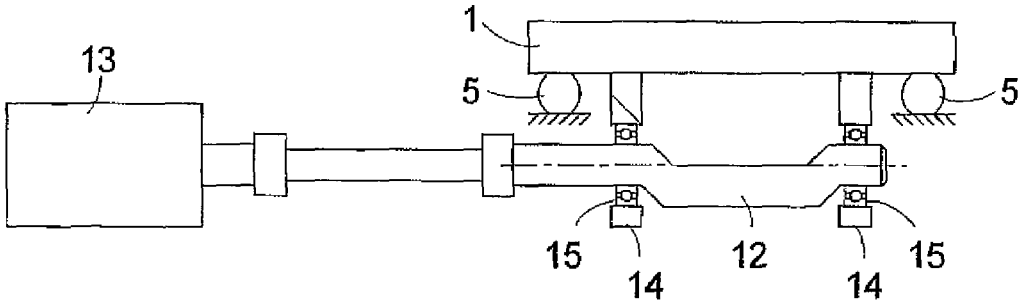
Prior Art Fig.3
FIG. 3 illustrates an unbalance shaft as known by the state of the art.

FIG. 3 shows an unbalanced shaft 12 of the conventional construction type, as it is not suitable for the production of concrete masonry by means of harmonic vibration. An unbalance shaft 12 is driven by a drive 13 which, for reasons of vibration technology, is in a position that is disconnected from table 1. Under table 1 there are mounts 14 that are shown here in cross section, with pendulum roller bearings 15 for the positioning of unbalance shaft 12. In this type of construction the unbalance mass and the unbalance forces thus able to be generated have strict limits of a maximum of 50 kN per unbalance shaft as otherwise the bearings would be exposed to unacceptably high loads leading to very short lifetimes.

Figure 4:
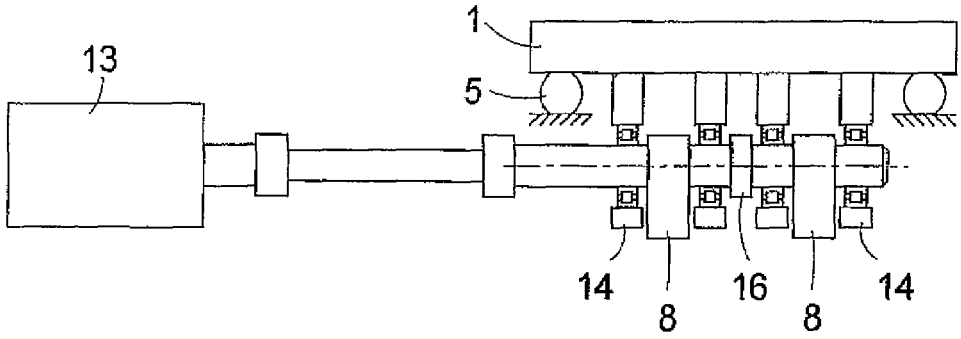
FIG. 4 illustrates an exemplary pair of coupled unbalance shafts in accordance with one aspect of the invention.

With the arrangement and use of unbalance shafts 8 as shown in FIG. 4 significantly higher forces can be achieved. Here there are two unbalance shafts 8 coupled by an elastic coupling 16 to form a pair. A drive 13 for the unbalance shafts 8, also due to reasons of vibration technology, is positioned disconnected from table 1. Each unbalance shaft 8 is held respectively by two mounts fastened to table 1 having cylinder roller bearings 17. The distance between the two cylinder roller bearing 17 in which a unbalance shaft 8 is positioned thus amounts to about 15 cm along the rotational axis of unbalance shaft 8.

In this manner the production of unbalance mass and unbalance radius of 0.7 kgm is able to be achieved so that, with an agitation cycle frequency of Omega=2×pi×60 Hz, individual unbalance forces or agitation force amplitudes of about 100% N per individual unbalance can be achieved without thus affecting the life time of cylinder roller bearings 17.

The invention claimed is:

1. A device for shaping conglomerates, comprising:

a form for the accepting concrete conglomerate;

a table coupled to the form;

a vibration generation system coupled to the table, the system adapted for generating harmonic vibrations and transferring the vibrations to the table;

a load adapted to admit the concrete conglomerate with a force;

first spring components for elastic positioning of the table;

second spring components for elastic positioning of the load; and wherein the vibration generation system includes at least eight rotating unbalance shafts having rotational axes parallel to each other; and wherein the unbalance shafts are coupled in pairs in their rotational movement so that each pair of unbalance shafts shares a rotational axis and is driven independently of the other pairs, at least one of the pairs comprising two unbalance shafts coupled with an elastic coupling having a torsion strength of at least $10^4$ Nm/rad and a maximum radial spring strength of $2\times10^7$ N/m.

2. The device of claim 1, wherein the unbalance shafts have an elasticity of at least $2\times10^5$ $Nm^2$.

3. The device of claim 1, wherein the unbalance shafts are made of steel and have a diameter of at least 80 mm.

4. The device of claim 1, wherein the unbalance shafts are positioned on the table by mounts having cylindrical roller bearings.

5. The device of claim 4, wherein two cylindrical roller bearings are provided with a bearing distance of about 150 mm for the positioning of each of the unbalance shafts.

6. The device of claim 1, wherein each pair of unbalance shafts is driven in synchronization via an electronic coupling.

7. The device of claim 1, wherein the table and the load are coupled using third spring components.

8. The device of claim 7, wherein the third spring components include mechanical springs having variable spring strengths.

9. The device of claim 7, wherein the third spring components include hydraulic springs having variable spring strengths.

10. The device of claim 1, wherein tension members are utilized as mounting components for coupling the form and the table, wherein the tension members have hydraulic or pneumatic traction, and wherein at one end the tension members are affixed to the table and at the other end they are coupled to the form in a flexible fastened state.

11. The device of claim 1, wherein tension members are utilized as mounting components for coupling the form and the table, wherein the tension members have hydraulic or pneumatic traction, and wherein at one end the tension members are affixed to the form and at the other end they are coupled to the table in a flexible fastened state.

12. The device of claim 1, wherein the coupling of the form and the table includes mounting components at the table that are wedges, and mounting components at the form that are tie rods having openings for the passage of the wedges so that, in the fastened state, the wedges enter the openings of the tie rods.

13. The device of claim 12, wherein a hydraulic forward and reverse drive is utilized for the wedges to increase and decrease tension.

14. The device of claim 12, wherein a pneumatic forward and reverse drive is utilized for the wedges to increase and decrease tension.

15. The device of claim 1, wherein the form includes a material that can be magnetized; and wherein electromagnets are attached to the table such that when the electromagnets are energized, the form is braced.

* * * * *